US006478005B2

(12) United States Patent
Tsubouchi

(10) Patent No.: US 6,478,005 B2
(45) Date of Patent: Nov. 12, 2002

(54) HANGER ARRANGEMENT FOR V-TYPE VERTICAL ENGINES AND OUTBOARD MARINE DRIVES

(75) Inventor: Masanori Tsubouchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/934,993

(22) Filed: Aug. 21, 2001

(65) Prior Publication Data

US 2002/0023617 A1 Feb. 28, 2002

(30) Foreign Application Priority Data

Aug. 25, 2000 (JP) ..... 2000-255989

(51) Int. Cl.[7] ..... B63H 5/12

(52) U.S. Cl. ..... 123/195 P; 123/198 R; 123/195 A

(58) Field of Search ..... 123/195 P, 195 A, 123/198 R

(56) References Cited

U.S. PATENT DOCUMENTS

| | | | | |
|---|---|---|---|---|
| 4,121,557 A | | 10/1978 | Congram et al. | 123/195 R |
| 5,007,393 A | | 4/1991 | Broughton et al. | 123/195 R |
| 5,616,058 A | * | 4/1997 | Nakai | 123/195 P |
| 5,694,895 A | * | 12/1997 | Tsunoda et al. | 123/195 P |
| 5,873,330 A | * | 2/1999 | Takahashi et al. | 123/195 P |
| 6,105,548 A | * | 8/2000 | Carlson et al. | 123/195 A |
| 6,309,267 B1 | * | 10/2001 | Okabe et al. | 123/195 P |
| 6,321,711 B1 | * | 11/2001 | Kato | 123/195 A |

FOREIGN PATENT DOCUMENTS

| | | |
|---|---|---|
| DE | 197 12 198 A | 9/1998 |
| FR | 2 766 145 A | 1/1999 |
| JP | 8-40378 | 2/1996 |
| JP | 10-18827 | 1/1998 |
| JP | 10-175596 | 6/1998 |

* cited by examiner

*Primary Examiner*—Noah P. Kamen
*Assistant Examiner*—J A Benton
(74) *Attorney, Agent, or Firm*—MacPherson Kwok Chen & Heid LLP

(57) ABSTRACT

Provided is a hanger arrangement for V-type vertical engines which not only allows the engine to be hoisted in a stable manner but also enhances the freedom in the design of the engine without interfering with other accessories and a hanger arrangement for outboard marine drives equipped with such an engine. A first and second hanger bracket are attached to outer sides of the cylinder heads, respectively, and a third hanger bracket is attached substantially centrally on an outer side of the crankcase. In particular, the third bracket is preferably located within the loop of an endless belt passed around a generator which is fixedly attached to the outer side of the crankcase.

6 Claims, 5 Drawing Sheets

HANGER ARRANGEMENT FOR V-TYPE VERTICAL ENGINES AND OUTBOARD MARINE DRIVES

TECHNICAL FIELD

The present invention relates to a hanger arrangement for V-type vertical engines and a hanger arrangement for outboard marine drives equipped with a V-type vertical engine.

BACKGROUND OF THE INVENTION

An engine for an outboard marine drive is typically provided with hangers for the convenience of mounting and dismounting the engine into and out of the main body case, and mounting and dismounting the outboard marine drive onto or off the boat. The positions of the hangers are determined so that the engine or outboard marine drive may be hoisted in a stable manner. Japanese patent laid open (kokai) publication No. 10-175596 filed by the same applicant discloses an arrangement in which a hanger bracket is provided centrally in an upper end surface of a cylinder block of a vertical engine to hoist the engine or the outboard marine drive. Japanese patent laid-open publication No. 8-40378 discloses an arrangement in which a pair of hanger brackets are provided along a diagonal line passing through the gravitational center of the engine. In such a case, the hanger brackets must be provided in such parts that are capable of withstanding the hoisting load, and hanger brackets are typically secured to the cylinder block or cylinder head of the engine. However, various components and accessories are attached around the engine, and there are various restrictions regarding the positions for securing the hanger brackets. Furthermore, because the gravitational center is fixed, it is not always easy to select two positions on a diagonal line passing through the gravitational center.

In particular, in case of a V-type engine which is preferred as a high-output, large-displacement engine, it is difficult to secure two points on a diagonal line passing through the gravitational center.

BRIEF SUMMARY OF THE INVENTION

In view of such problems of the prior art, a primary object of the present invention is to provide a hanger arrangement for hoisting a V-type vertical engine in a stable manner, and a hanger arrangement for an outboard marine drive equipped with such an engine.

A second object of the present invention is to provide a hanger arrangement for a V-type vertical engine which allows a high level of freedom in design and minimizes the interference with other accessories, and a hanger arrangement for an outboard marine drive equipped with such an engine.

According to the present invention, such objects can be accomplished by providing a hanger arrangement for V-type vertical engines having a substantially vertically oriented crankshaft, a cylinder block having a pair of cylinder axial lines disposed substantially horizontally and in a V-shape, a pair of cylinder heads each attached to a corresponding side of the cylinder block to define a combustion chamber, and a crankcase fixedly attached to another side of the cylinder block to define a crank chamber accommodating the crankshaft, comprising: a first and second hanger bracket attached to outer sides of the cylinder heads, respectively; and a third hanger bracket attached substantially centrally on an outer side of the crankcase.

Thus, the hanger brackets may be provided in the peripheral part of the engine which is relatively free from interferences, and the engine may be hoisted by three points surrounding the gravitational center of the engine or outboard marine drive. In particular, the restriction to the mounting of accessories and engine components can be minimized.

The mounting position for the generator tends to create a problem. However, even when the generator is attached to an outer side of the crankcase and having an input shaft extending vertically upward, the third hanger bracket can be attached to the outer side of the crankcase within a loop of an endless belt which is passed around a drive pulley fixedly attached to an upper end of the crankshaft and a driven pulley fixedly attached to the input shaft of the generator without any problem.

In particular, if the hanger brackets project upwardly from an upper end surface of the cylinder heads and crankcase, the hoisting work can be accomplished in an efficient way.

When an outboard marine drive is formed by connecting a propulsion unit to the lower end of the cylinder block of such an engine, the same hanger arrangement may be used for mounting the outboard marine drive onto and off the watercraft, and servicing the outboard marine drive, and hoisting the outboard marine drive as a whole.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
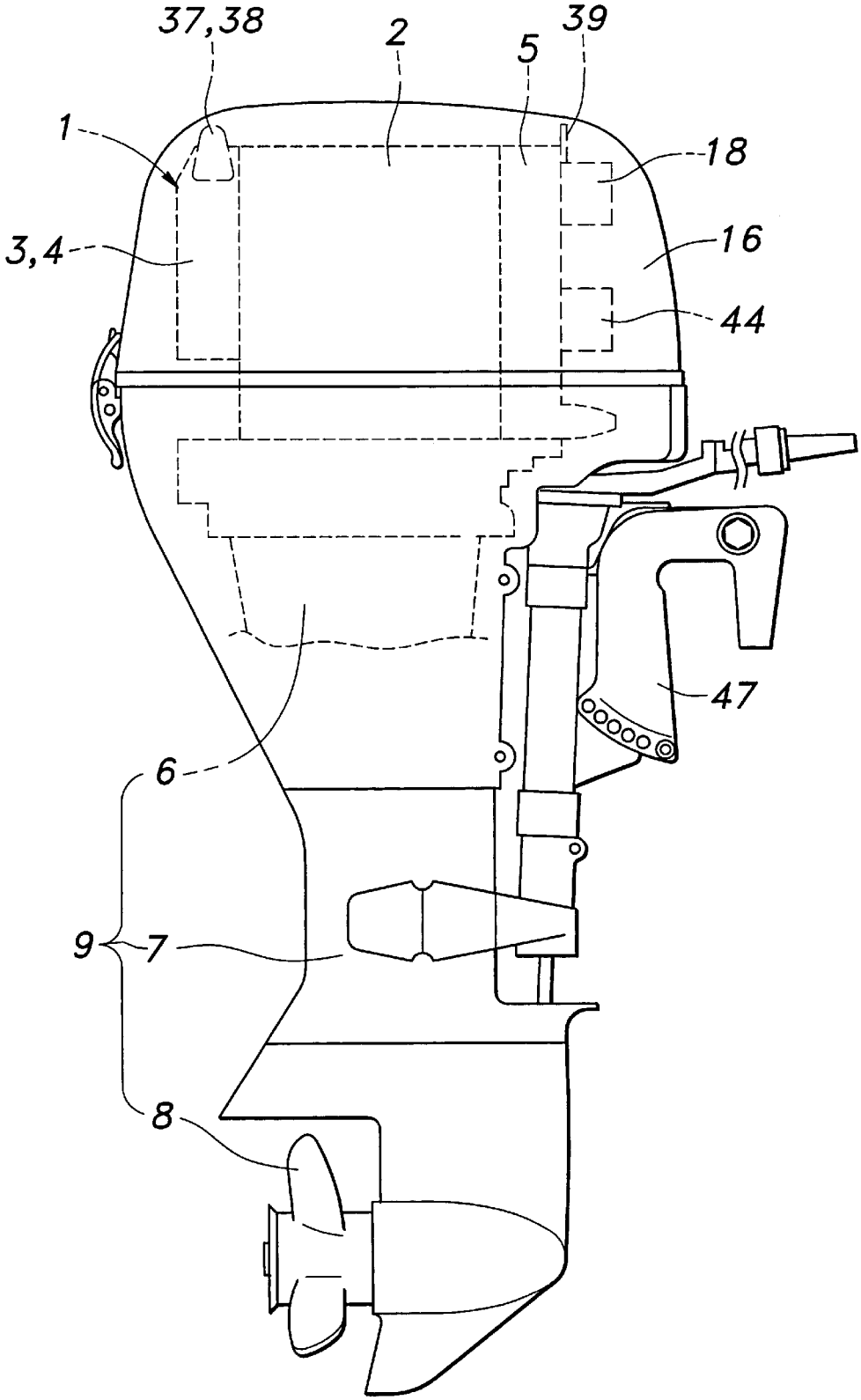
FIG. 1 is a side view of an outboard marine drive equipped with a V-type vertical engine embodying the present invention.
Figure 2:
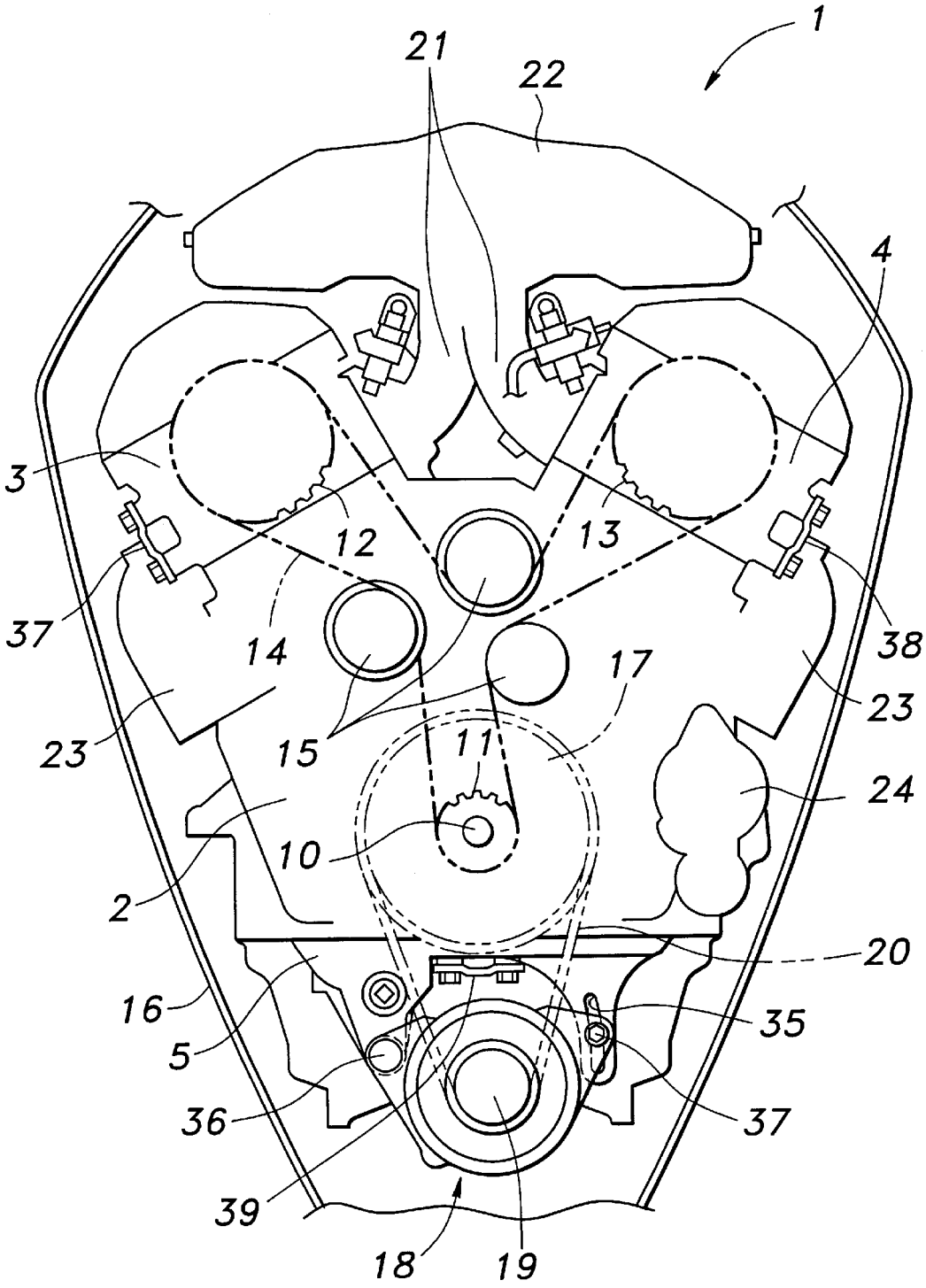
FIG. 2 is a plan view showing an essential part of the V-type vertical engine shown in FIG. 1.

FIGS. 1 and 2 show an outboard marine drive equipped with a V-type vertical engine 1 embodying the present invention. This engine 1 consists of a V-type six-cylinder engine, and comprises a V-shaped cylinder block 2 having a pair of cylinder banks, a crankcase 5, and a pair of cylinder heads 3 and 4. The engine 1 is covered by a cowling 16. The lower end of the engine 1 is connected to a propulsion unit 9 including a gear housing 6, a screw 8 and an extension case 7 accommodating a power train leading to the screw 8.

To the upper end of a crankshaft 10 is connected a camshaft drive pulley 11, and to the upper end of a camshaft (not shown in the drawing) provided in each cylinder head is connected a camshaft driven pulley 12, 13. A timing belt 14 is passed around the camshaft drive pulley 11 and camshaft driven pulleys 12 and 13, and is guided and appropriately tensioned by three idle pulleys 15 including a tension pulley.

To the upper end of the crankshaft 10 is fixedly attached an ACG drive pulley 17, and an ACG drive endless belt 20 is passed around the ACG drive pulley 17 and an ACG driven pulley 19 attached to an input shaft of an ACG 18 fixedly attached to the crankcase 5.

The inner sides of the cylinder heads 3 and 4 opposing each other support a common intake device 22 via an intake manifold 21 attached to each cylinder head 3, 4. The outer sides of the cylinder heads 3 and 4 are provided with exhaust manifolds 23, respectively. On one side of the cylinder block 2 is mounted a starter motor 24.

Figure 5:
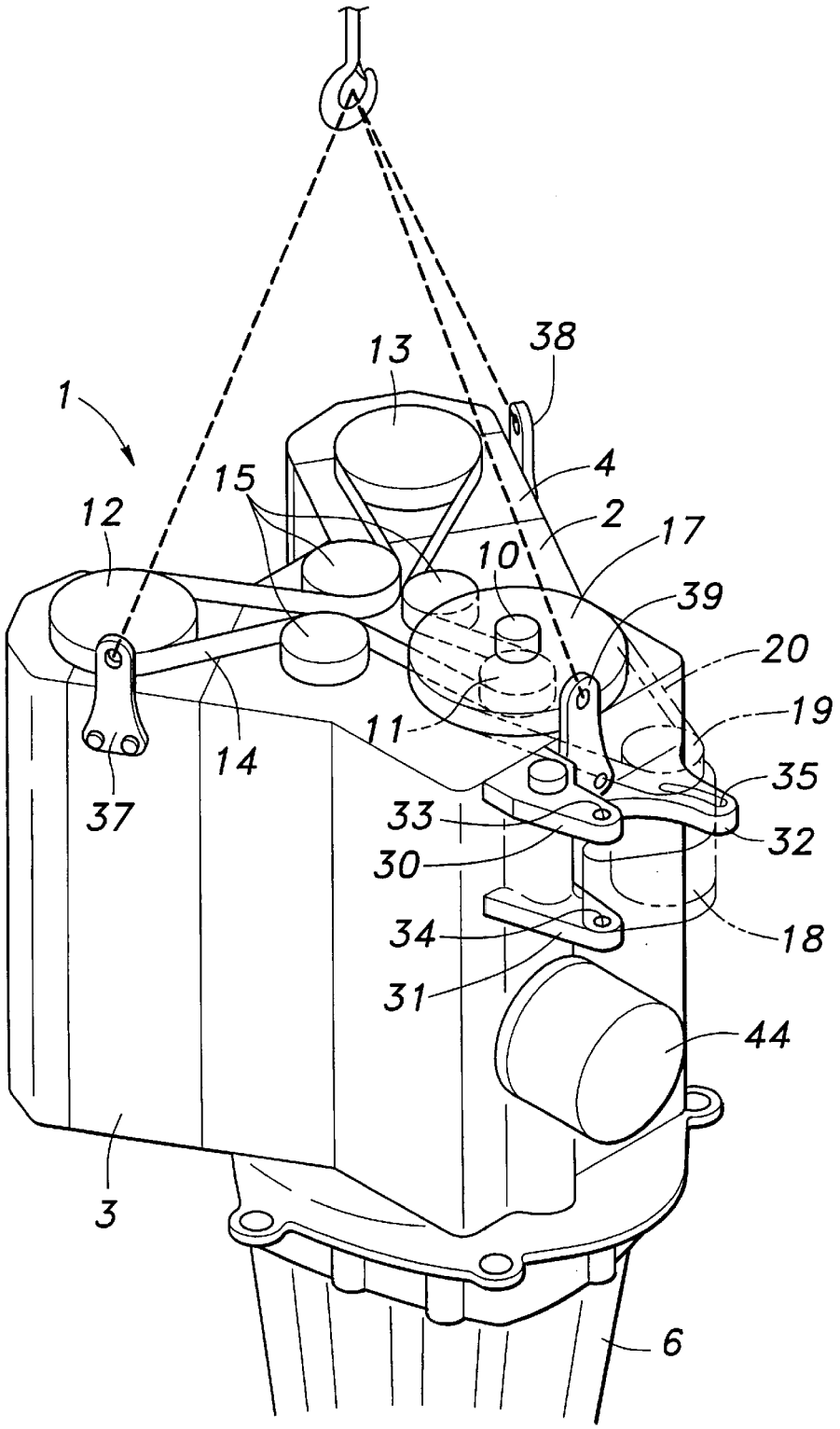
FIG. 5 is a perspective view showing the mode of hoisting the V-type vertical engine shown in FIG. 1.

As best shown in FIG. 5, brackets 30, 31 and 32 are integrally cast on the outer surface of the crankcase 5 to attach the ACG 18, and project laterally outward. In this embodiment, these brackets 30, 31 and 32 project outwardly without any overhang so that the mold elements may be removed laterally without any problem when casting the crankcase 5. The first and second brackets 30 and 31 are formed with mounting holes 33 and 34 which align vertically to each other so that the ACG 18 may be pivotally supported around a vertical axial line by passing a threaded bolt 36 through these holes 33 and 34 and a corresponding mounting hole of the ACG 18. The third bracket 32 laterally opposes the other brackets 30 and 31, and is provided with an arcuate slot 35 corresponding to the rotational trajectory of the ACG 18. A threaded bolt 37 is passed through a mounting hole of the ACG 18 and slot 35, and after turning the ACG 18 around the threaded bolt 36 so as to apply a desired tension to the ACG drive endless belt 29, the threaded bolt 37 is fastened to fixedly secure the ACG 18 at this position.

Figure 3:
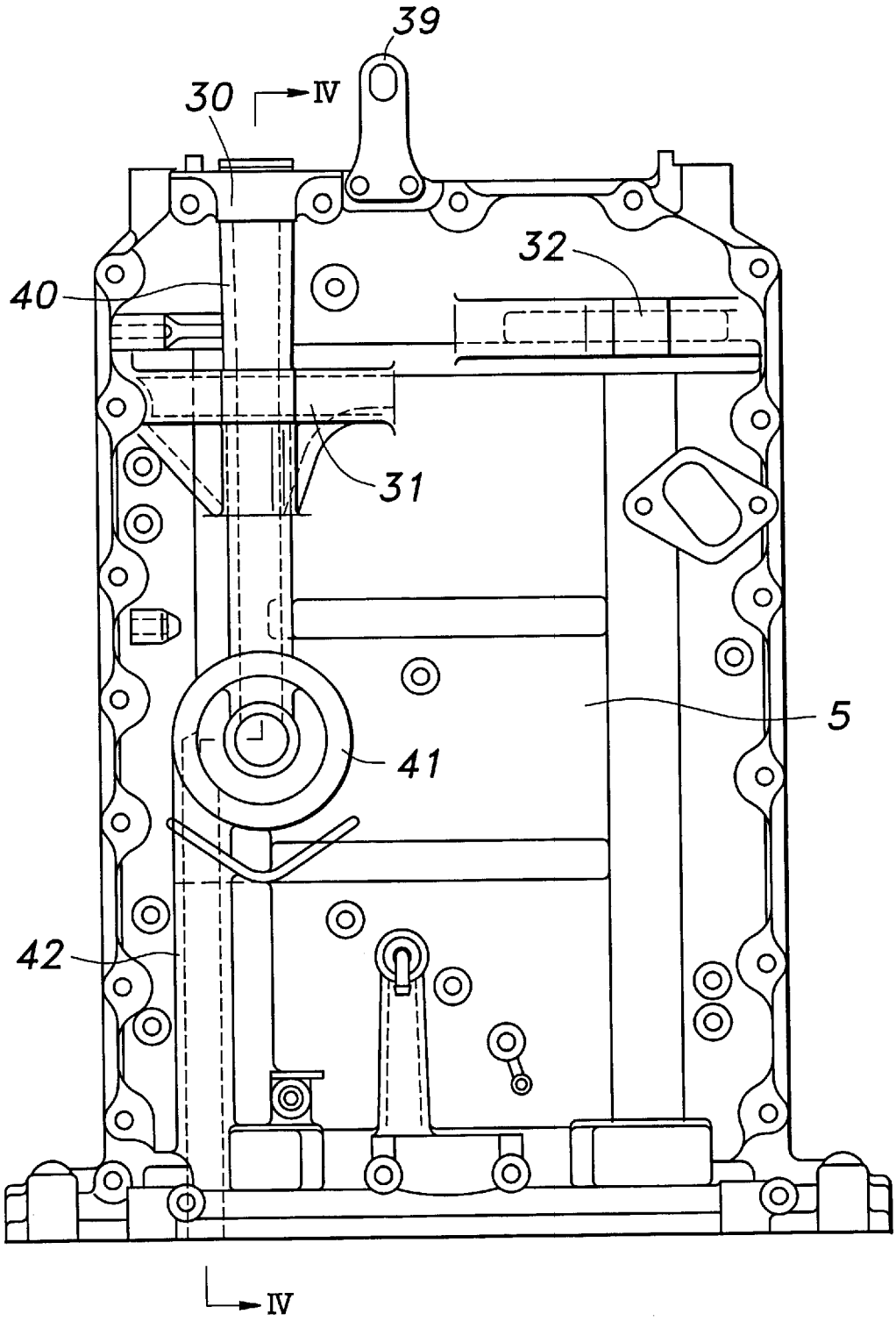
FIG. 3 is a bottom view showing the crankcase of the V-type vertical engine shown in FIG. 1.
Figure 4:
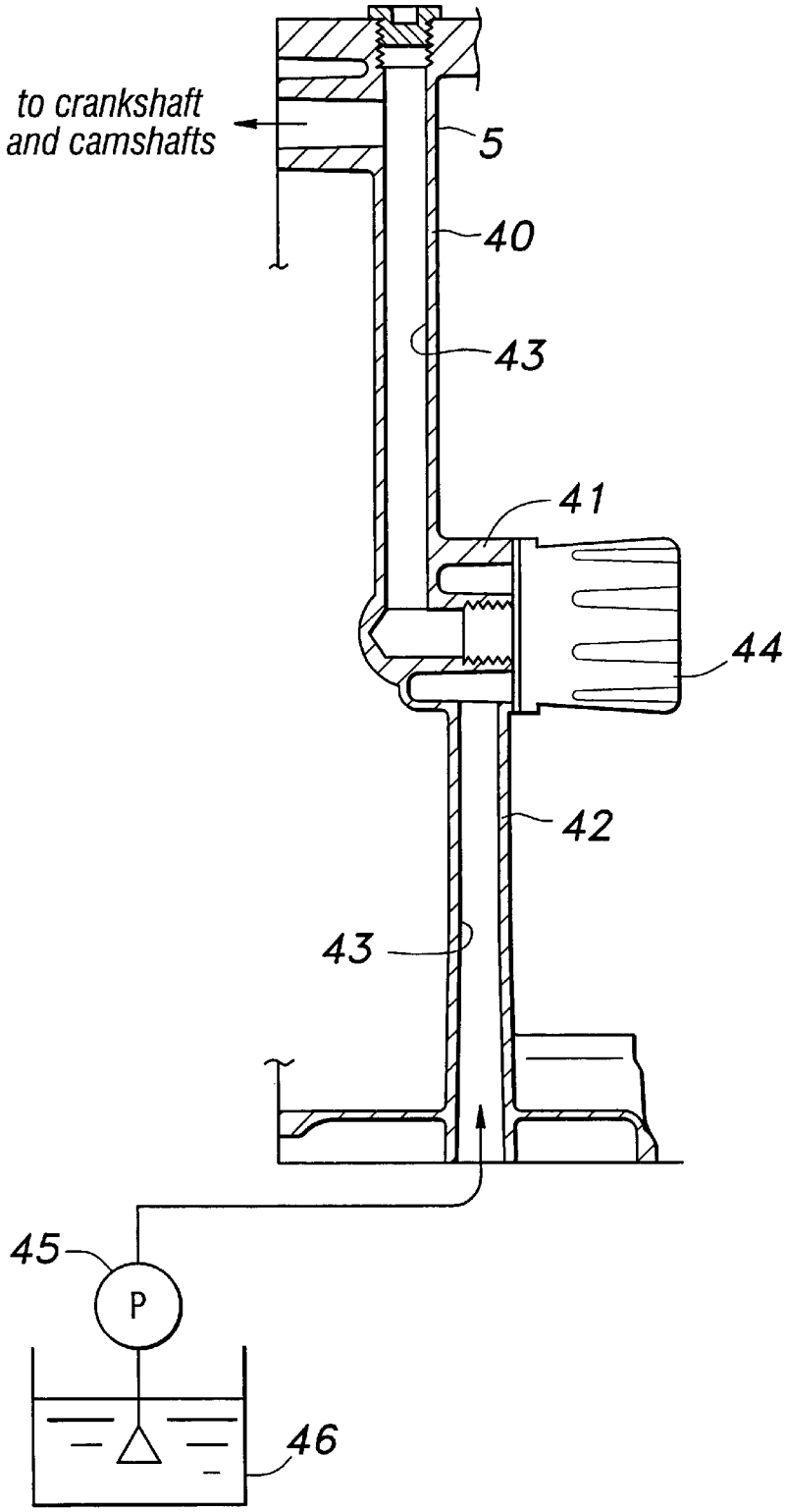
FIG. 4 is a sectional view taken along line IV—IV of FIG. 3.

As shown in FIGS. 3 and 4, in such a vertical engine, an oil gallery is provided in the crankcase 5 to feed the engine oil drawn by an oil pump 45 from an oil sump 46 provided in a lower part of the engine to the crankshaft and camshaft via a passage provided in the upper end of the cylinder block 2. In this embodiment, on the outer surface of the crankcase 5 extend a first ridge 40 between the first and second brackets 30 and 31, and a second ridge 42 between the second bracket 31 and gear housing 6 via an annular boss 41 for mounting an oil filter 44, both in the vertical direction. As best shown in FIG. 4, these ridges 40 and 42 internally define a passage 43 serving as an oil gallery.

Such a relatively large outboard marine engine equipped with a starter motor is required to have an ACG having a corresponding large output capacity, and needs a structure having a mechanical strength that is required for mounting a relatively large and heavy ACG. Therefore, conventionally, relatively large steel brackets were mounted on the upper surface of the crankcase to support a relatively large and heavy ACG. However, it was sometimes difficult to secure a necessary mounting surface, and the number of components and the amount of the assembly work were unacceptably great. The present invention eliminates such a problem by using ACG mount brackets integrally cast with the crankcase. To ensure a sufficient mechanical strength even when the crankcase has a relatively thin wall, ridges 40 and 42 extend substantially over the entire length of the crankcase and connect the first and second brackets 30 and 31 to each other. Furthermore, these ridges also contribute to a compact design of the engine as they are used for defining a passage 43 serving as an oil gallery.

In this embodiment, the three hanger brackets 37, 38 and 39 are attached to the outer sides of the cylinder heads 3 and 5 and an upper central part of the outer surface of the crankcase 5 by using threaded bolts. Therefore, these threaded bolts can be fastened from sideways, and this reduces the possibility of interferences from other component parts. The cylinder heads 3 and 4 have a large wall thickness, and have an adequate mechanical strength to hoist the engine. As for the crankcase 5, the hanger bracket 39 is secured to a base of the first ACG mounting bracket 30 which may be given with a desired wall thickness. In particular, by using three points for hoisting the engine as shown in FIG. 5, the hanger brackets can be secured to the parts of the engine which are relatively peripheral to the engine and relatively free from the interferences from other components, and the engine may be hoisted in a stable manner.

Thus, the present invention not only allows the engine to be hoisted in a stable manner but also enhances the freedom in the design of the engine or the outboard marine drive by allowing the hanger brackets to be provided in such parts which would not interfere with other accessories. In particular, accessories can be freely arranged in upper parts of the engine block without causing any inconvenience to the mounting of the ACG.

Although the present invention has been described in terms of a preferred embodiment thereof, it is obvious to a person skilled in the art that various alterations and modifications are possible without departing from the scope of the present invention which is set forth in the appended claims.

What is claimed is:

1. A hanger arrangement for V-type vertical engines having a substantially vertically oriented crankshaft, a cylinder block having a pair of cylinder axial lines disposed substantially horizontally and in a V-shape, a pair of cylinder heads each attached to a corresponding side of said cylinder block to define a combustion chamber, and a crankcase fixedly attached to another side of said cylinder block to define a crank chamber accommodating said crankshaft, comprising:

a first and second hanger bracket attached to outer sides of said cylinder heads, respectively; and a third hanger bracket attached substantially centrally on an outer side of said crankcase.

2. A hanger arrangement for V-type vertical engines according to claim 1, further comprising:

a generator attached to an outer side of said crankcase and having an input shaft extending vertically upward;

a driven pulley fixedly attached to said input shaft of said generator;

a drive pulley fixedly attached to an upper end of said crankshaft; and an endless belt passed around said two pulleys;

said third hanger bracket being attached to the outer side of said crankcase within a loop of said endless belt.

3. A hanger arrangement for V-type vertical engines according to claim 1, wherein said hanger brackets project upwardly from an upper end surface of said cylinder heads and crankcase.

4. A hanger arrangement for outboard marine drives including a V-type vertical engine and a propulsion unit connected to a lower end of said engine, said engine comprising a substantially vertically oriented crankshaft, a cylinder block having a pair of cylinder axial lines disposed substantially horizontally and in a V-shape, a pair of cylinder heads each attached to a corresponding side of said cylinder block to define a combustion chamber, a crankcase fixedly attached to another side of said cylinder block to define a crank chamber accommodating said crankshaft, comprising:

a first and second hanger bracket attached to outer sides of said cylinder heads, respectively; and a third hanger bracket attached substantially centrally on an outer side of said crankcase.

5. A hanger arrangement for outboard marine drives according to claim 4, further comprising:

a generator attached to an outer side of said crankcase and having an input shaft extending vertically upward;

a driven pulley fixedly attached to said input shaft of said generator;

a drive pulley fixedly attached to an upper end of said crankshaft; and an endless belt passed around said two pulleys;

said third hanger bracket being attached to the outer side of said crankcase within a loop of said endless belt.

6. A hanger arrangement for outboard marine drives according to claim 4, wherein said hanger brackets project upwardly from an upper end surface of said cylinder heads and crankcase.

* * * * *